United States Patent [19]

Seeley

[11] 4,273,993

[45] Jun. 16, 1981

[54] TERMINATIONS FOR ELECTRIC HEATING ELEMENTS

[75] Inventor: Wayne R. Seeley, Pulaski, Va.

[73] Assignee: Emerson Electric Co., St. Louis, Mo.

[21] Appl. No.: 148,821

[22] Filed: May 12, 1980

[51] Int. Cl.[3] ..... H05B 3/08

[52] U.S. Cl. ..... 219/541; 219/552; 219/544; 338/236; 338/273; 339/191 S; 339/256 SP; 339/258 F

[58] Field of Search ..... 339/76, 191 S, 210 R, 339/217 R, 256 SP, 258 F; 219/451, 536, 541, 544, 552; 338/232, 233, 234, 235, 236, 237, 273, 302, 316

[56] References Cited

U.S. PATENT DOCUMENTS

| | | | |
|---|---|---|---|
| 2,559,943 | 7/1951 | Cerny | 338/237 |
| 2,596,837 | 5/1952 | Calvert | 338/236 X |
| 2,600,188 | 6/1952 | Batcheller | 339/256 SP |
| 2,760,173 | 8/1956 | Cunningham | 339/76 |
| 2,995,645 | 8/1961 | Kawalle | 219/544 X |
| 3,253,243 | 5/1966 | Martin | 338/316 |
| 3,514,744 | 5/1970 | Hollander | 339/191 S |
| 3,569,787 | 3/1971 | Palmer | 219/552 X |
| 3,717,841 | 2/1973 | Mancini | 339/258 F |

FOREIGN PATENT DOCUMENTS

| | | | |
|---|---|---|---|
| 1224631 | 3/1971 | United Kingdom | 338/237 |

*Primary Examiner*—Volodymyr Y. Mayewsky
*Attorney, Agent, or Firm*—Michael Williams

[57] ABSTRACT

The invention relates to a termination for a tubular electric heater, comprising a two-piece body of ceramic or high-temperature plastic which is quickly and easily assembled with a metal spade terminal. The two pieces of the body have interfitting parts which align the pieces longitudinally. One of the pieces has a cavity with a tapered entrance portion for receiving a complementarily-tapered portion of the spade terminal, the latter having a tubular portion crimped about the end of the resistance wire. The invention is adapted for use with a rectilinear heater tube, which may be of glass, quartz or a metal such as aluminum, and simular terminations close respective opposite ends of the tube. The resistance wire is disposed within the tube and is in the form of a helical coil which is tensioned on assembly to draw each termination in abutting relation with a respective end of the tube.

4 Claims, 5 Drawing Figures

TERMINATIONS FOR ELECTRIC HEATING ELEMENTS

BACKGROUND AND SUMMARY

The invention is particularly adpated for use with separable and quick-connect male and female metal terminals of any commercially available type, such as Ark-Les, Amp, Hollingsworth and others.

The prior art includes tubular electric heating elements wherein the termination at each end of the tube comprises a metal spade terminal for quick connection to a female member that is electrically connected to a power conductor. In the constructions presently known the spade terminal is either welded to, or integral with, the terminal pin of the heater, and does not lend itself to the easy assembly operation made possible by the present invention.

As herein disclosed the termination at each end of a rectilinear heater comprises a two-piece body of electric insulating material, such as ceramic or high-temperature plastic. The two-pieces have interfitting parts to locate the same, and one has a cavity for receiving a metal spade terminal.

DESCRIPTION OF THE DRAWINGS

In the drawings accompanying this specification and forming a part of this application there is shown, for purpose of illustraton, an embodiment which my invention may assume, and in this drawing.

DESCRIPTION OF THE PREFERRED EMBODIMENT

The construction herein disclosed is particularly adapted for use as a browning element for microwave ovens, or as a heating element for toaster broilers or as a radiant heater, although it is not limited to such uses. The heating element includes a tubular sheath 10 which is usually cylindrical and rectilinear, and of a length suitable for the particular use for which the heater is designed. Depending upon the use, the sheath may be of glass, quartz or metal, particularly aluminum and the like.

Figure 1:
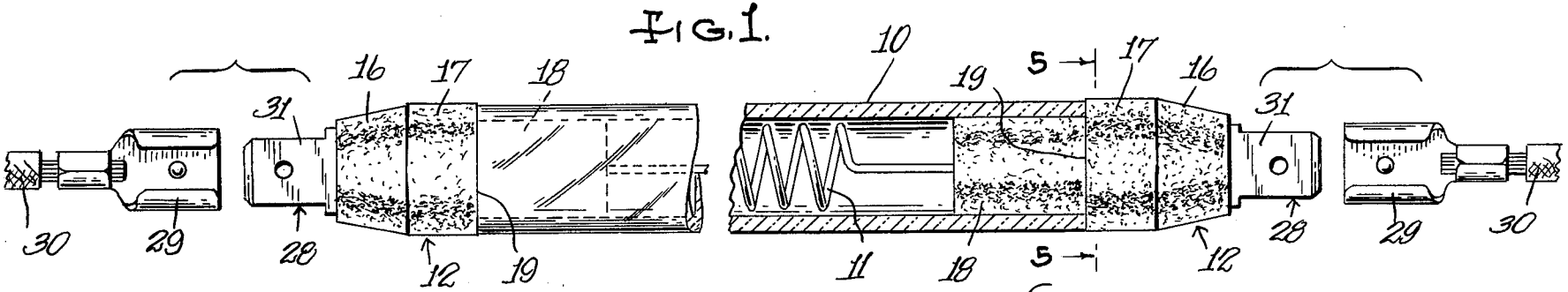
FIG. 1 is a fragmentary longitudinal view of a tubular electric heating element which incorporates my invention, parts being shown in section.

A helically-coiled resistance wire 11 is disposed within the sheath, and when the latter is glass or quartz, may merely be spaced from the interior surface of the sheath, as shown in FIG. 1. In the event that the sheath is of metal, suitable material, not shown but well known, must be disposed within the sheath to electrically insulate the latter from the resistor wire.

Figure 2:
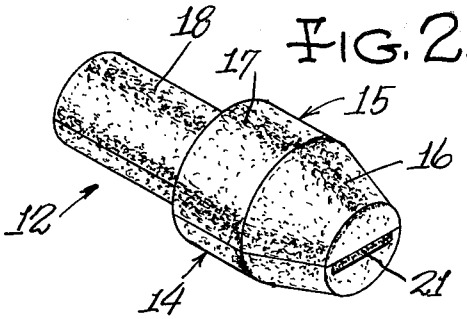
FIG. 2 is a perspective view of an insulator body shown in FIG. 1.
Figure 4:
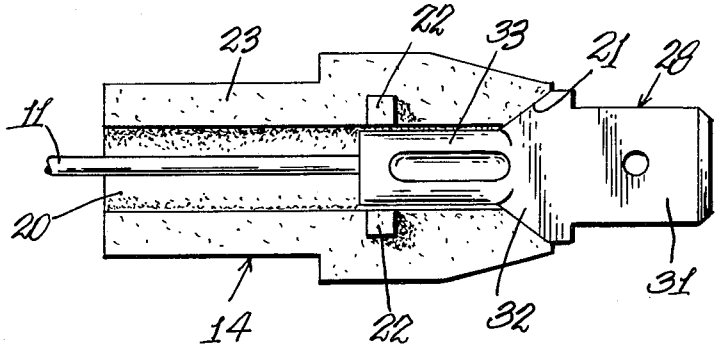
FIG. 4 is an enlarged plan view of one piece of the insulator body with a spade terminal in place.

As seen in FIG. 1 end plugs 12 close the opposite ends of the sheath and in accordance with the present invention, each end plug includes an insulator body of multi-piece construction. In the preferred embodiment the terminal body is formed of two longitudinal pieces 14 and 15 which are in the form of complementary halves to form the complete insulator body shown in FIG. 2. The body pieces may be formed of any suitable rigid electrical insulating material, such as a molded ceramic or a high-temperature plastic.

When assembled, the body pieces 14 and 15 form an end plug having a tapered nose portion 16, a round intermediate portion 17, and a further round portion 18 of reduced diameter and adapted to fit within an open end of the sheath, as seen in FIG. 1, an amount limited by abutment of the shoulder 19 with the transverse end surface of the sheath.

Figure 3:
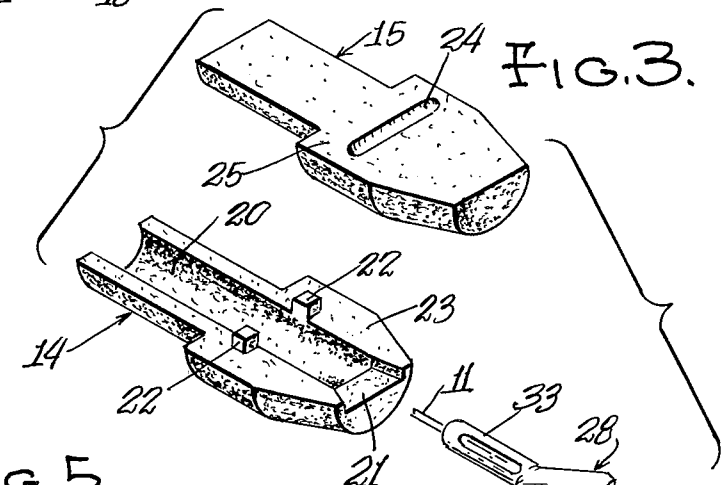
FIG. 3 is a separated perspective view of the two pieces of the insulator body and the spade terminal used in connection therewith.
Figure 5:
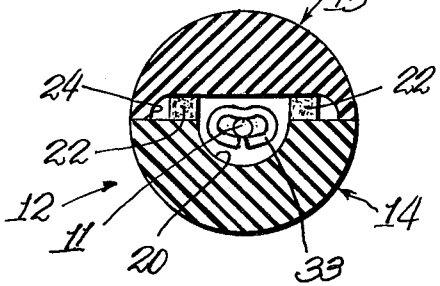
FIG. 5 is an enlarged, transverse sectional view corresponding to the line 5—5 of FIG. 1.

As best seen in FIG. 3 the body half 14 has a longitudinally extending cavity 20 which may be semi-circular in cross section as seen in FIG. 5. At the forward end of the nose portion 16 the cavity communicates with an outwardly-tapering entranceway 21. Lugs 22—22 extend from the plane surface 23 of the body half 14 and are adapted to fit within a groove 24 formed in the plane surface 25 of the body half 15 to hold the body halves longitudinally aligned and against material lateral misalignment. The body halves 14 and 15 are held against separation, with their plane surfaces 23 and 25 in abutment, when the round portion 18 is disposed within the sheath end.

A metal spade terminal 28 is carried by a terminal body to provide connection of the resistor wire 11 with a source of electrical energy. The terminal 28 is of any well-known construction, such as shown in U.S. Pat. No. 2,600,188, and is adapted to fit in conventional manner within a female connection 29 which is connected to a conductor 30 adapted to supply electrical energy to the resistance wire 11.

The spade terminal 28 has the usual flat blade 31 formed with a wedge-like portion 32, the latter being adapted to fit closely within the tapered entranceway 21 to hold the spade terminal against movement in a direction inward of the sheath 10. The spade terminal has a tubular portion 33 which is crimped about the adjacent end of the resistor wire 11. The end portion 33 is adapted to lie within the cavity 20, and is contained therein when the body halves are assembled.

Assembly of the heater is a relatively simple matter, and may be accomplished by unskilled workers after only a minimum of instruction. The resistor wire is previously provided with the crimped-on spades 28. In the case where the resistor wire need not be insulated from the sheath, such as when the sheath is of glass or quartz, the resistor is threaded into the sheath and a two-piece insulator body is closed on the spade terminal and the end portion 18 of the body is inserted into the tube end. The spade terminal 28 at the opposite end of the sheath is pulled outwardly of such end, and the coiled wire 11 is stretched in this process. Another two-piece insulator body is closed on this spade terminal and the end portion 18 of this body is inverted in such opposite sheath end.

The resiliency of the coiled wire 11 is sufficient in many cases to maintain the insulator bodies adequately assembled with the sheath. In some cases it may be necessary to provide a friction fit between the body portion 18 and the interior of the tube end. Where the heater is disposed in a hazardous gaseous environment, it may be necessary to cement the body portion 18 within the tube end. In such case, a high-temperature cement of any commercially-available type may be used.

I claim:

1. A termination for an electric heater having a tubular sheath and a resistance conductor extending longitudinally within said sheath, said termination comprising, an end plug for closing an open end of said sheath, said end plug comprising an insulator body formed of a plurality of longitudinal segments which interact laterally to form said end plug, a metal spade terminal having a tubular portion connected to an end of said resistance conductor, at least one of said segments having a longitudinally-extending recess to receive said spade terminal tubular portion, said spade terminal having a blade extending axially from said end plug and adapted to connect with a female terminal, the latter being connectable to a power conductor, at least one of said segments having a socket for receiving a portion of said blade, said blade portion being engageable with a shoulder provided by said socket to restrict movement of said spade terminal in a direction inwardly of said sheath, said resistance conductor being in the form of a helically-coiled wire which is stressed to resiliently hold said blade portion against said shoulder, and said end plug having an end portion adapted to seat within said tubular sheath open end.

2. The construction according to claim 1 wherein said body segments have cooperating abutments and recesses to longitudinally align said segments.

3. A termination for an electric heater having a tubular sheath and a resistance conductor extending longitudinally within said sheath, said termination comprising, an end plug for closing an open end of sheath, said end plug comprising a two-piece insulator body, said pieces interfitting laterally to form said end plug, a metal spade terminal having a tubular portion crimped on an end of said resistance conductor, one of said body pieces having a longitudinally-extending recess to receive said tubular portion and the other of said body pieces in its interfitting position having a surface overlying said recess for holding said tubular portion within said recess, said spade terminal having a flat blade extending axially from an end portion of said end plug and adapted to connect with a female terminal, the latter being connectable to a power conductor, said blade having a wedge-shaped portion, said one body piece having a socket for receiving said blade portion, said socket having a complementarily-tapered portion to closely receive said wedge-shaped blade portion to provide interabutting surfaces to hold said spade terminal from being drawn into said sheath, said end plug having an opposite end portion adapted to be seated within said tubular open end, said recess in said one body piece extending from said plug opposite end portion through said one body piece in a direction axially thereof, and communicating with said socket at the first-named end portion of said plug, said resistance conductor being in the form of a helically-coiled wire which is stressed to tend to pull said spade terminal in a direction inwardly of said sheath.

4. The construction according to claim 3 wherein said one body piece has lugs on opposite sides of said recess, said lugs fitting within a groove formed in the other of said body pieces to longitudinally align said pieces in interfitting relation.

* * * * *